US008101843B2

(12) United States Patent
Turner

(10) Patent No.: US 8,101,843 B2
(45) Date of Patent: Jan. 24, 2012

(54) SYSTEM AND METHOD FOR PACING REPETITIVE MOTION ACTIVITIES

(75) Inventor: William D. Turner, San Diego, CA (US)

(73) Assignee: Pacing Technologies LLC, San Diego, CA (US)

( * ) Notice: Subject to any disclaimer, the term of this patent is extended or adjusted under 35 U.S.C. 154(b) by 0 days.

(21) Appl. No.: 12/916,869

(22) Filed: Nov. 1, 2010

(65) Prior Publication Data

US 2011/0061515 A1 Mar. 17, 2011

Related U.S. Application Data

(63) Continuation of application No. 11/244,241, filed on Oct. 6, 2005, now Pat. No. 7,825,319.

(51) Int. Cl.
*G10H 7/00* (2006.01)

(52) U.S. Cl. ..... 84/612; 482/3

(58) Field of Classification Search ..... 84/612; 700/94; 482/900, 901, 3–9
See application file for complete search history.

(56) References Cited

U.S. PATENT DOCUMENTS

| | | | | |
|---|---|---|---|---|
| 4,164,732 | A | 8/1979 | Pischiera | |
| 4,337,529 | A * | 6/1982 | Morokawa | 377/20 |
| 4,413,821 | A | 11/1983 | Centafanti | |
| 4,660,107 | A | 4/1987 | Chippendale, Jr. | |
| 4,776,323 | A | 10/1988 | Spector | |
| 4,788,983 | A * | 12/1988 | Brink et al. | 600/547 |
| 4,969,384 | A | 11/1990 | Kawasaki et al. | |
| 5,137,501 | A | 8/1992 | Mertesdorf | |
| 5,215,468 | A * | 6/1993 | Lauffer et al. | 434/236 |
| 5,267,942 | A * | 12/1993 | Saperston | 600/28 |
| 5,343,871 | A | 9/1994 | Bittman et al. | |
| 5,451,922 | A | 9/1995 | Hamilton | |
| 5,592,143 | A * | 1/1997 | Romney et al. | 340/309.16 |
| 5,662,117 | A | 9/1997 | Bittman | |
| 5,830,107 | A | 11/1998 | Brigliadoro | |
| 5,869,783 | A | 2/1999 | Su et al. | |
| 6,013,007 | A * | 1/2000 | Root et al. | 482/8 |
| 6,036,573 | A | 3/2000 | Huang | |
| 6,185,527 | B1 | 2/2001 | Petkovic et al. | |

(Continued)

FOREIGN PATENT DOCUMENTS

JP 2001306071 A 11/2001

(Continued)

OTHER PUBLICATIONS

Author Unknown, "Natural Health Web—Music and Sound Therapy Information," pp. 1-8, accessed on Jun. 17, 2009 at www.naturalhealthweb.com/topics/subtopics/music & sound therapy.html.

(Continued)

*Primary Examiner* — Jeffrey Donels
(74) *Attorney, Agent, or Firm* — Blank Rome LLP

(57) ABSTRACT

Disclosed is a system and method that allows users to customize audible and visible signals, such as music or video, to maintain a pre-determined or specified pace or to achieve a new pace in repetitive motion activities such as, but not limited to, running, walking, swimming, cycling, aerobics, and the like. Other applications of the system and method include, but are not limited to, enhancing the results of medical rehabilitation programs, physical therapy, weight loss programs, disc jockey services, and industries or manufacturing settings where repetitive motion is common and where audible cues designed to help users maintain a consistent pace are useful.

37 Claims, 7 Drawing Sheets

U.S. PATENT DOCUMENTS 6,230,047 B1 * 5/2001 McHugh ..... 600/519
6,232,540 B1 5/2001 Kondo
6,244,988 B1 6/2001 Delman
6,246,362 B1 * 6/2001 Tsubata et al. ..... 342/357.35
6,312,363 B1 11/2001 Watterson et al.
6,448,485 B1 9/2002 Barile
6,571,248 B1 5/2003 Kusama
6,572,511 B1 * 6/2003 Volpe ..... 482/4
6,605,020 B1 8/2003 Huang
6,607,493 B2 * 8/2003 Song ..... 600/502
6,623,427 B2 * 9/2003 Mandigo ..... 600/300
6,625,541 B1 9/2003 Shenoy et al.
6,626,799 B2 9/2003 Watterson et al.
6,629,101 B1 9/2003 Enokida
6,716,139 B1 4/2004 Hosseinzadeh-Dolkhani et al.
6,746,247 B2 6/2004 Barton
6,808,473 B2 * 10/2004 Hisano et al. ..... 482/8
6,837,827 B1 1/2005 Lee et al.
7,003,122 B2 * 2/2006 Chen ..... 381/67
7,177,672 B2 * 2/2007 Nissila ..... 600/519
7,207,935 B1 * 4/2007 Lipo ..... 600/28
7,224,282 B2 5/2007 Terauchi et al.
7,572,205 B1 8/2009 Cribar
7,586,032 B2 9/2009 Louis
2001/0003542 A1 * 6/2001 Kita ..... 381/334
2002/0091049 A1 * 7/2002 Hisano et al. ..... 482/148
2002/0091796 A1 * 7/2002 Higginson et al. ..... 709/218
2003/0066413 A1 4/2003 Nishitani et al.
2003/0139254 A1 7/2003 Chang
2004/0127335 A1 7/2004 Watterson et al.
2004/0257432 A1 12/2004 Girish et al.
2004/0263337 A1 12/2004 Terauchi et al.
2005/0049113 A1 * 3/2005 Yueh et al. ..... 482/8
2005/0126370 A1 * 6/2005 Takai et al. ..... 84/636
2005/0129253 A1 * 6/2005 Chen ..... 381/67
2005/0141729 A1 * 6/2005 Kanzaki et al. ..... 381/67
2005/0201572 A1 9/2005 Lindahl et al.
2005/0266961 A1 12/2005 Shum et al.
2005/0288154 A1 12/2005 Lee et al.
2006/0067535 A1 3/2006 Culbert et al.
2006/0067536 A1 3/2006 Culbert et al.
2006/0084551 A1 * 4/2006 Volpe, Jr. ..... 482/8
2006/0102171 A1 * 5/2006 Gavish ..... 128/95.1
2006/0107822 A1 * 5/2006 Bowen ..... 84/612
2006/0111621 A1 * 5/2006 Coppi et al. ..... 600/300
2006/0136173 A1 6/2006 Case et al.
2006/0153040 A1 7/2006 Girish et al.
2006/0169125 A1 * 8/2006 Ashkenazi et al. ..... 84/612
2006/0185502 A1 8/2006 Nishitani et al.
2006/0221788 A1 10/2006 Lindahl et al.
2006/0243120 A1 * 11/2006 Takai et al. ..... 84/612
2006/0253210 A1 11/2006 Rosenberg
2006/0262120 A1 11/2006 Rosenberg
2006/0274905 A1 12/2006 Lindahl et al.
2006/0276919 A1 * 12/2006 Shirai et al. ..... 700/94
2006/0288846 A1 * 12/2006 Logan ..... 84/612
2007/0044641 A1 * 3/2007 McKinney et al. ..... 84/612
2007/0060446 A1 * 3/2007 Asukai et al. ..... 482/8
2007/0074617 A1 4/2007 Vergo
2007/0074618 A1 * 4/2007 Vergo ..... 84/612
2007/0074619 A1 * 4/2007 Vergo ..... 84/612
2007/0149362 A1 6/2007 Lee et al.
2007/0208544 A1 9/2007 Kulach et al.
2007/0288157 A1 12/2007 Peterman
2008/0096727 A1 4/2008 Lee et al.
2008/0143547 A1 6/2008 Burrell et al.
2008/0153671 A1 6/2008 Ogg et al.
2008/0190202 A1 8/2008 Kulach et al.
2008/0214358 A1 9/2008 Ogg et al.
2008/0214360 A1 9/2008 Stirling et al.
2009/0063049 A1 3/2009 Swisher et al.
2009/0076765 A1 3/2009 Kulach et al.
2009/0192391 A1 7/2009 Lovitt et al.
2009/0295596 A1 12/2009 Downey et al.
2010/0009811 A1 1/2010 Lee et al.
2011/0022349 A1 1/2011 Stirling et al.

FOREIGN PATENT DOCUMENTS

JP 2001346928 A 12/2001
JP 2002073018 A 3/2002
JP 2002140080 A 5/2002
JP 2003085888 A 3/2003
JP 2003108154 A 9/2003
JP 2003305146 A 10/2003
JP 2004113552 A 4/2004
JP 2004302011 A 10/2004
JP 2003177750 A 1/2005

OTHER PUBLICATIONS

Sundquist, "Exercise Pacing & Use of Music," Nov. 3, 1999, 7 pp.
Underhill, et al., MP3: Complete Idiots Guide to MP3, UCSD Library, ML 74.4 M6 U 64, 2000, S&E Stacks.
Hart, et al., MP3: I Didn't Know You Could Do That, UCSD Library, ML 74.4 M6 H 37, 1999, S&E Stacks.
Hacker, MP3: The Definitive Guide, ML 74.4 M6 H 33, 2000, S&E Stacks.
Author Unknown, "ID3.org," 2 pp., most recently accessed on Jun. 6, 2011 at http://www.id3.org/.
English translation of JP2003305146.

* cited by examiner

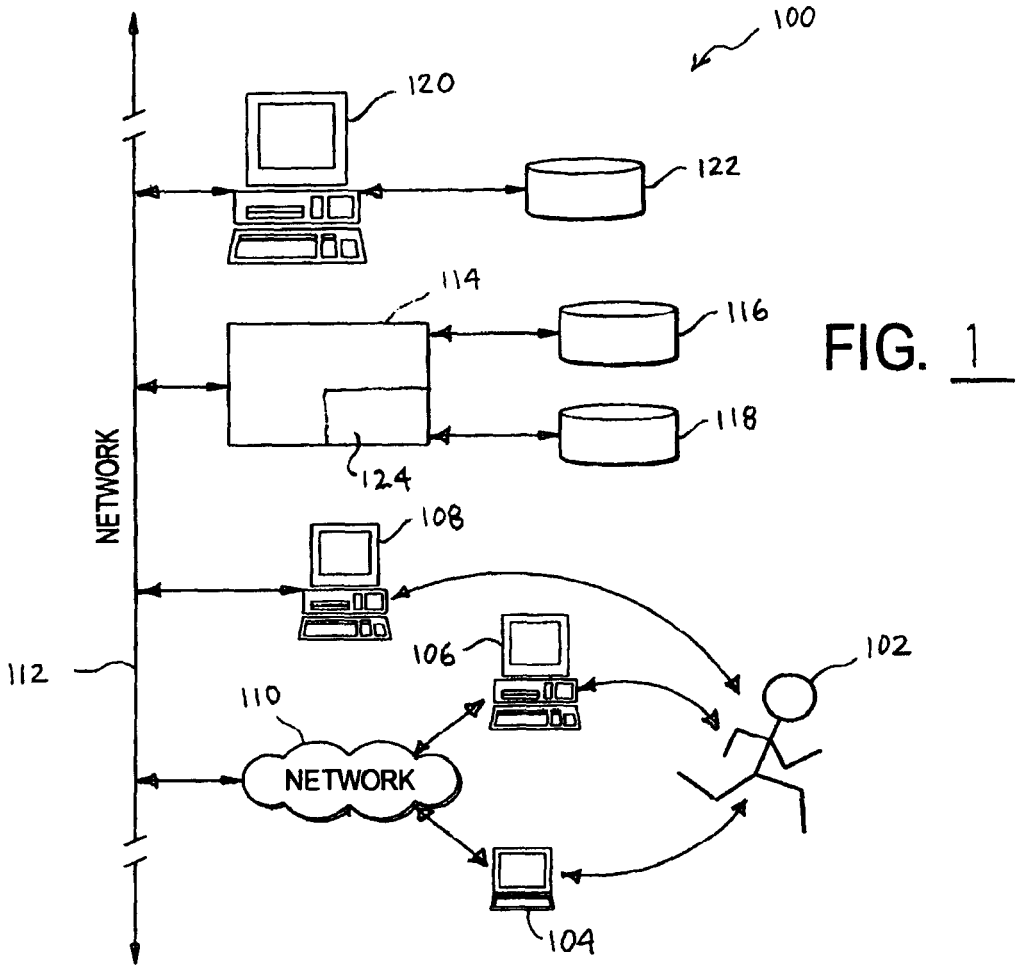
FIG. 1
FIG. 6
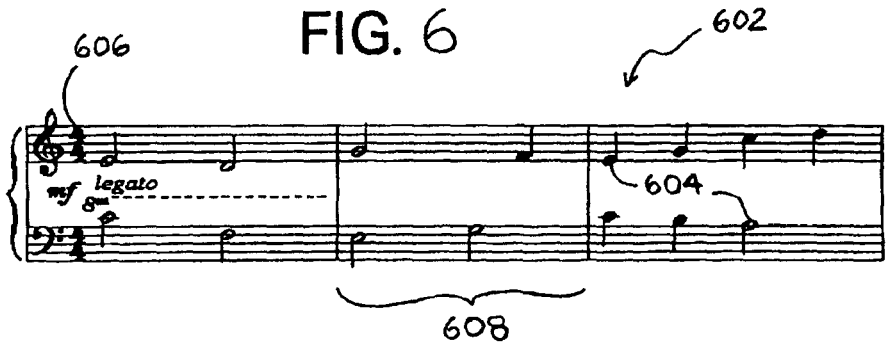

FIG. 7
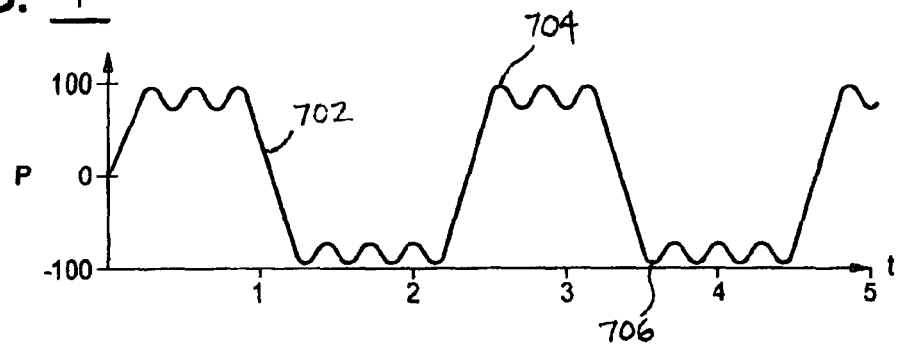
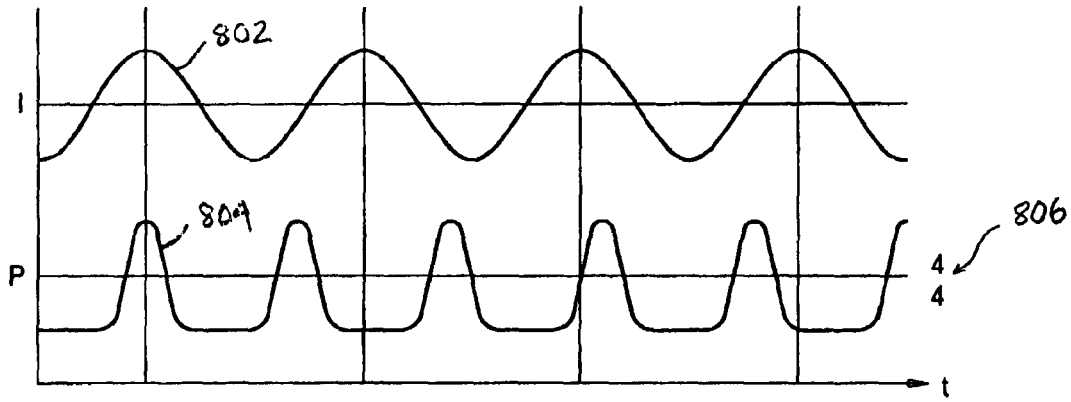
FIG. 8
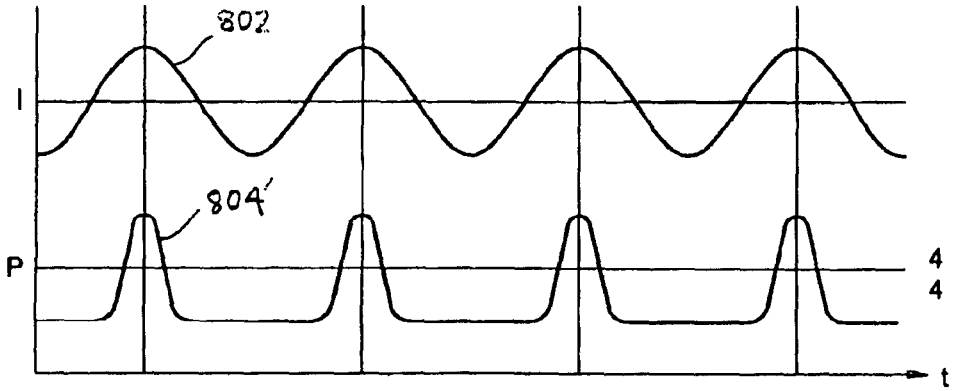
FIG. 9

SYSTEM AND METHOD FOR PACING REPETITIVE MOTION ACTIVITIES

CROSS-REFERENCE TO RELATED APPLICATION

The present application is a continuation of and claims the benefit of U.S. patent application Ser. No. 11/244,241, filed Oct. 6, 2005, now U.S. Pat. No. 7,825,319 the entire disclosure of which is incorporated by reference herein.

BACKGROUND OF THE INVENTION

1. Field of Invention

The present invention relates generally to systems and/or methods for pacing individuals involved in repetitive motion activities to achieve an optimal or desired performance goal, in particular, the present invention relates to hardware and software systems and methods that allow individuals involved in repetitive motion activities such as running, walking, swimming, cycling, aerobics, and the like, to select and use audible or visible information characterized by tempos that match the individuals' repetitive activity tempo to increase the chances of reaching an optimal active level and complete an active within a desired time period.

2. Description of Related Art

Devices for use by individuals engaged in repetitive motion activities, such as athletes, laborers, and artists, are known in the art. U.S. Pat. No. 4,164,732, for example, discloses a pacing device involving a portable frequency generator adapted to be worn by an athlete, that emits audible tone bursts at selectable time intervals. The patent teaches that the device is used to train individuals, such as runners, to achieve a desired time goal for whatever repetitive motion activity they are involved in.

There are many types of audible sounds that can be used for pacing an individual, including simple tone bursts, as described above, the ticking of a metronome, and the tempo of music, to name a few. U.S. Pat. No. 5,215,468, for example, discloses an apparatus for modifying the tempo of a musical piece and the output of an associated amplification device as a motivational tool for joggers. The invention uses an adjustable drive motor to incrementally increase the rate at which the musical piece is played by the device, which is disclosed as being a subliminal change not noticed by the user. The patent discloses that the invention may be used by marathoners and disc jockeys.

Pacing tools can be used to optimize the performance of an individual engaged in a repetitive motion activity once the individual's optimal or desired pace is known or determined, U.S. Pat. No. 6,716,247, for example, discloses a method for producing an instructional tool for an athlete that teaches the athlete appropriate rhythm, timing, and tempo by using the athlete's own best performance as a template to compose a new musical piece (as opposed to modifying an existing musical piece) having a specific tempo. The patent discloses that the athlete's tempo is analyzed as he performs an activity, and then a song is composed having a tempo that matches the tempo of the analyzed activity and that achieves an optimal level of performance of the athlete. The patent discloses that software may be used to modify the athlete's choice of musical piece, to include modifying the tempo of the musical piece and inserting pre-recorded notes or sounds, such as a metronome beat, into the musical piece. An audio file player may be used to play back the tempo-modified musical piece to the athlete.

In addition to those pacing devices, other pacing systems incorporate information about the individual, his or her location, and the type of activity involved to further personalize and enhance the ability of the individual performing the repetitive motion activity. Japanese Patent Publication 2004-113552, for example, discloses an exercise aid device capable of informing an exercising individual of an appropriate walking tempo. The disclosed device calculates a walking pitch based on physical information of the exercising individual and information about the course being walked. The device displays a list of music pieces having a tempo nearly matching the individual's tempo, changes the tempo of a selected musical piece to match the calculated tempo, and plays the tempo-modified musical piece as the individual performs the activity.

Japanese Patent Publication 2003-108154 discloses a device and method for distributing music having a known tempo (called a "load speed") to a user based on received activity patterns heart rate) relayed from a terminal device associated with the user to a distribution device that selects, and downloads to the user a musical piece from a database of musical pieces having a known tempo. The device and method are intended to facilitate an optimal level of exercise by encouraging the user to exercise at the tempo of the musical piece such that the user's heart rate is maintained as close to a pre-determined heart rate as possible. The reference does not disclose modifying the tempo of the music pieces in the database.

Because different individuals perform at different levels of peak intensity for the same repetitive task, audible pacing tools have been altered in order to reflect each individual's movements. Where the pacing tool is music, an audible tone may be added to existing music or the beats per minute of the music may be altered. U.S. Pat. No. 6,448,485, for example, discloses digitally adding audible information to an existing digital music data files.

What the aforementioned prior art systems and methods fail to address, however, is the need for a system and method thr pacing individuals involved in repetitive motion activities that involves a plurality of user profiles and accessible music data files maintained by a networked server in data communication with a plurality of users' electronic devices, each of the devices adapted to providing automatic location information to the server and outputting audio and video information that the users can employ for pacing purposes.

SUMMARY AND OBJECTS OF THE INVENTION

It should be apparent that there exists a need for a computer-implemented system and method for providing to repetitive activity users over a wired or wireless communications network, like the Internet, music pieces or tempo-modified music pieces that are stored on a server system in data communication with an audio or video playback device operated by the user for pacing purposes, the music pieces being automatically or manually downloaded based on information in a plurality of individual user profiles stored on the server system. There also exists a need for a system and method that uses mapping and global positioning system (GPS) telemetry data tied to the audio or video playback device and server system that automatically selects tempo-adjusted music or adjusts the tempo of current music piece being played as a user performs a repetitive motion activity. The advantages of the present invention include: maintaining a large catalogue of audio and video data files that are constantly being updated and available to users; providing easy accessibility and downloading of information files using Internet Protocol-enabled devices (or using other information distribution protocols); automatically providing location-based information about the user without the need for different networked devices; allowing for storing and analyzing information in user profiles to enhance the information provided by the system; and having the ability to analyze patterns and habits of users accessing the system.

Accordingly, it is a principal object of the present invention to provide a computer-implemented, network-based system having a networked server, database, client computer, and input/output device for use by individuals engaged in repetitive motion activities, and a method of using the same by those individuals to achieve their time-based and/or pace-based goals for completing repetitive motion activities.

It is another object of the present invention to provide an Internet-based system to deliver system-provided services. However, the invention contemplates using existing portable audio devices, modification of existing portable audio devices, file sharing networks, on-demand radio or television services, cable services, cable television service, satellite radio or television, software programs, cellular phone, cellular phone network, or other devices, networks, software or systems used in place of or in association with an Internet-based system to alter the tempo of music and distribute or sell such music for the purpose of pacing repetitive motion activities.

It is still another object of the present invention to provide a software program specifically designed to allow users to modify the tempo or beats-per-minute (BPM) of songs for the purpose of creating tempo-driven music and enhancing athletic or other types of repetitive motion activities. Such software could be freeware or be purchased and downloaded onto the users' computers or portable storage and playback devices.

It is another object of the present invention to provide a system and method involving an Internet map service or Internet-based topographical database for creating customized music corresponding to routes and topography in many locations that a user may traverse during an activity involving repetitive motions.

It is still another object of the present invention to provide an Internet-based system and method whereby disc jockeys, radio stations, television stations, and other content users and providers can obtain customized music to suit their production needs.

It is another object of the present invention to provide a system and method whereby music producers and musicians can submit audio content that can be modified for users' pacing needs.

It is still another object of the present invention to provide a system and method that allows a user to customize music by adding audible sounds, signals, statements, phrases, or tempos in order to distinguish the customized music from the original.

It is another object of the present invention to provide a system and method that allows users to add audible sounds, signals, statements, phrases, or tempos to songs that help users identify a song's tempo for pacing purposes.

It is still another object of the present invention to provide a system and method that incorporates GPS devices to determine information including, but not limited to, the distance traveled, speed, pace, stride length, and geographic location of the user.

It is another object of the present invention to provide a system and method that provides users with access to databases of songs categorized by BPM for use in pacing repetitive motion activities.

It is still another object of the present invention to provide a system and method whereby users can download mixes of songs according to BPM, enabling users to achieve desired heart rates, or to burn a desired number of calories during an activity.

It is another object of the present invention to provide a system and method that links data derived from heart rate monitors, pace monitors, pedometers and the like with databases containing the BPM of all catalogued songs, to achieve heart rate and/or pacing goals.

It is still another object of the present invention to provide a system and method that links the service to athletic training programs customized to meet users' personal fitness goals.

It is another object of the present invention to provide a system and method that links the service to franchised, commercially-available weight loss, exercise, and diet programs to enable users to achieve weight loss, exercise, and diet program goals through paced repetitive motion activities.

It is still another object of the present invention to provide a system and method that links the service to repetitive motion exercise equipment such as treadmills, elliptical machines, stair climbing machines, skiing simulation machines, stationary bicycles, and the like for the purpose of pacing repetitive motion activities.

It is another object of the present invention to provide a system and method that links the service to exercise classes such as aerobic classes, stationary bicycle "spinning" classes, dance classes, martial arts classes, boxing classes, kick boxing classes, and the like for the purpose of pacing repetitive motion activities.

It is still another object of the present invention to provide a system and method that accepts recordings of newly created or composed music, compensates composers, catalogues songs in a database according to BPM (and a variety of other variables), and allows for dissemination, tempo modification, and/or sale to users.

It is another object of the present invention to provide a system and method useful to medical rehabilitation programs, physical therapy, weight loss programs, disc jockey services, and industries or manufacturing settings where repetitive motion is common, and where audible cues designed to help people maintain a consistent pace are useful.

It is still another object of the present invention to provide a repetitive motion activity device, such as a treadmill, having all the features of the system and that is responsive to the BPM of the music or the tempo of the user or can itself change the BPM of the music as the user engages in the use of the repetitive motion activity device.

Briefly described, those and other objects and features of the present invention are accomplished, as embodied and fully described herein, by a repetitive motion pacing system that includes a user profile database containing a plurality of user-provided parameters, at least one of the user-provided parameters being a target tempo value that is substantially the same as an actual tempo of a repetitive motion activity to be performed by a user; a storage device, including a file sharing database containing at least one data file having information for producing a tempo that is sensible to the user as the user performs the repetitive motion activity; a data storage and playback device adapted to producing the sensible tempo; and a communications network for receiving the at least one data file and distributing the at least one data file to the data storage and playback device. The repetitive motion pacing system can automatically determine a geographic location of the data storage and playback device, which can be done using GPS data. The system also includes a file selection means that can automatically select a plurality of data files based on the geographic location of the data storage and playback device and distribute the plurality of data files to the data storage and playback device. The objects and features of the system also include a tempo computing means for determining the target tempo, which can be done by counting a number of repetitions occurring over a measured time period, and a software subsystem for modifying the tempo information contained in the at least one data file.

The data storage and playback device includes an automatic location information component for determining the location of the data storage and playback device; a signal output component for outputting a sensible signal from the data storage and playback device; an input/output component for entering commands into and receiving information from the data storage and playback device; a data storage component for storing the at least one data file; and a communications component for sending and receiving information to and from the data storage and playback device.

The objects and features of the present invention are also accomplished, as embodied and fully described herein, by a method involving the steps of receiving in a user profile database at least one user-provided parameter including a target tempo value that is substantially the same as an actual tempo of a repetitive motion activity to be performed by a user; receiving in a storage device, including a file sharing database at least one data file having information for producing a tempo that is sensible to the user as the user performs the repetitive motion activity; comparing the target tempo value to the tempo information in the at least one data file to generate an output signal; and providing the output signal via a communications network to a data storage and playback device. The method of the invention also includes the steps of modifying the tempo information of the at least one data file so it is substantially the same as the target tempo; modifying the at least one data file to add tempo information to the file; determining the location of the data storage and playback device; comparing the location of the data storage and playback device to a database of location points, wherein each of the database of location points includes a corresponding geographic tempo value; comparing the geographic tempo values to the tempo information in the at least one data file; and using the data storage and playback device to reproduce the output signal and generate an audible sound that is sensible by the user.

With those and other objects, advantages and features of the invention that may become hereinafter apparent, the nature of the invention may be more clearly understood by reference to the following detailed description of the invention, the appended claims and to the several drawings attached herein.

BRIEF DESCRIPTION OF THE DRAWINGS

FIG. 1 is a drawing depicting a schematic of the main system architecture of a repetitive motion pacing system according to one aspect of the present invention;

FIG. 6 is a drawing of a portion of a musical piece depicted in the form of sheet music;

FIG. 7 is a graph of a sound wave represented by a line curve according to one aspect of the present invention;

FIG. 8 is a diagram of a graph showing a curve representing the change in intensity of a repetitive motion activity and a sound wave curve;

FIG. 9 is a diagram showing the curves in FIG. 8 after the sound wave has been tempo-modified to match the intensity curve;

DETAILED DESCRIPTION OF THE PREFERRED EMBODIMENT

Figure 2:
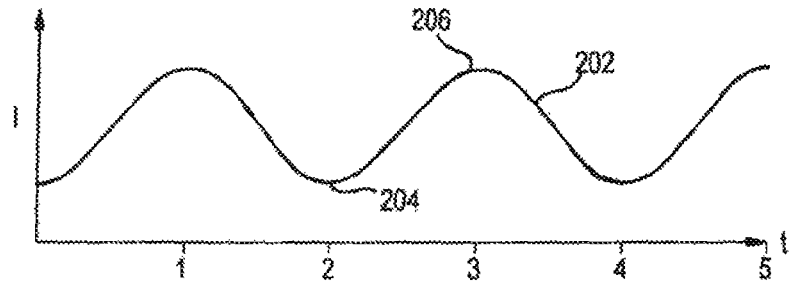
FIG. 2 is a graph of a repetitive motion activity represented by a sinusoidal curve according to one aspect of the present invention.

Several preferred embodiments of the invention are described for illustrative purposes, it being understood that the invention may be embodied in other forms not specifically shown in the drawings.

I. System Architecture.

FIG. 1 is a drawing depicting a schematic of the main system architecture of a repetitive motion pacing system 100 according to one aspect of the invention. The system 100 includes a user 102, which is shown as an individual but could be a group of individuals, a corporate entity, a governmental entity, or other person(s) thing(s). The invention contemplates that the user 102 will have submitted information, in the form of an application, potentially with a fee, to become a subscriber of the system 100. The subscription provides the user 102 with different levels, amounts, or degrees of access to information stored on a server computer (described below) associated with the system 100.

The user 102 can communicate with and receive information provided by the system 100 using wired or wireless electronic devices 104, 106, and/or 108. The device 104 could be, for example, a wireless telephone, a wired telephone, a personal data assistant, or a portable computer. The device 106 could be, for example, a desktop computer. The device 108 could also be a desktop computer. Combinations of those electronic devices, or other types of electronic devices capable of sending and receiving electronic, optical, and electro-optical signals, may be used. A separate data storage and music playback device, which is adapted to receiving and/or sending electronic signals to/from devices 104, 106, and/or 108 and for storing and manipulating the electronic signals is described later.

As shown in FIG. 1, the devices 104 and 106 are connected to a first data communications network 110, and the device 108 is connected to a second data communications network 112. The particular connectivity of the devices 104, 106, and 108 to the first and second networks 110, 112 is for illustrative purposes only. The network 110 may be, for example, a wireless network used by mobile computing devices like cellular telephones. The network 112 may be, for example, the Internet, an intranet, or some other network system. Preferably, the networks 110, 112 are packet-switched networks capable of routing hypertext, extensible, or other types of mark-up language code and data in accordance with the standard Internet Protocol or some other protocol in order to generate web pages. The Internet Engineering Task Force is the standards body that creates and maintains the basic standards on which the Internet depends, including the Internet Protocol specification published in 1981.

The first and second networks 110, 112 are connected or interconnected to a server subsystem 114, which can include one or more server computers (not shown) that are adapted to, among other things, storing and processing data generating responses to client computer requests thr markup language files and information, and providing access to user information. The user 102 can use one or more of the electronic devices 104, 106, and 108 to access the server subsystem 114 preferably via a web site graphical user interface that is generated on the electronic devices 104, 106, and 108, using markup language commands and data provided to those devices by the server subsystem 114.

The server subsystem 114 is capable of interfacing with one or more databases 116, 118, as shown in FIG. 1. The database 116 could be, for example, a database containing records of each user's profile and preferences. The user profiles may include personal information, such as, but not limited to, the user's name, gender, height, weight, fitness level, repetitive motion activities, duration of activities, physical address, email address, stride length, distance to be covered, desired goal time, and desired goal pace. Personal information may also include health-related information, such as heart rate, pulse, calories burned, and other information. Preferences may include, but are not limited to, music artist, album, song title, and musical genre. In addition to including personal information and preferences, the user profile may also include subscription-related information, such as the type of subscription, fees paid and due, system access times and duration, physical and billing address information, and the number of downloads from the system. The preferences may also include one or more rules, pre-defined by the user 102 or determined heuristically and automatically by the system 100 over time as it "learns" the user 102. The rules define how the system 100 is to adapt to the user 102 while the user is engaged in a repetitive motion activity. The user profile may also include address information associated with the electronic devices 104, 106, and 108 used to access the system 100 and that receive downloads, in-case-of-emergency (ICE) contact information, and technical information about the user's data storage and music playback device, including system settings in case the system 100 is damaged, and other types of information.

The database 118 could be, for example, a database containing individual data files. Preferably, the data files are music files, preferably in a compressed format, obtained from a user 102 or from a third party source, although text and video files (or combinations of audio, text, and video files) are also contemplated as being within the scope of the invention. The audio files may be stored in a single format, or multiple copies of the file may be stored in a different format. The video files may include information for producing moving images of various routes a user 102 might run, walk, cycle, etc. Methods for converting audio (and text and video) data files from one format to another are well known in the art.

The server subsystem 114 includes a software subsystem 124, which will be described later.

Also shown in FIG. 1 is a server 120 connected to a database 122. The server 120, which is shown connected to the network 112 but could instead be connected through some other data communications network, is, for example, a third party vendor computer system. The server subsystem 114 can download music or other audio, video, or text data files from the server 120. Thus, for example, the server 120 could be associated with a major music production and marketing company that stores a catalogue of digital music pieces on the database 122. The server 120 and database 122 are accessible by persons who agree to take a license from the third party vendor.

It is also contemplated that the server 120 could be a computer in a peer-to-peer computer network. That is, the server 120 and the computer 108 could be used to share audio, video, and text data files over the network 112 in a peer-to-peer manner with each device operating as a server and a client computer. The user 102 could then upload those data files to the server subsystem 114 and store them in the database 118.

As described above, the many objects of the present invention involve using music or other types of audio and/or video signals to enhance or optimize the performance of an individual engaged in a repetitive motion activity. FIGS. 2-5 are graphs having curves that represent different types of repetitive motions. For example, shown in FIG. 2 is a graph of a repetitive motion activity that is represented by a sinusoidal curve 202. The curve 202 is actually a series of individual points plotted on a time scale, t, having unit time period, intervals t1, t2, t3, t4, t5, etc. Each point represents a level of intensity, I, associated with the repetitive activity. The curve 202 suggests that the intensity of the activity increases sinusoidally over time from a minimum 204 to a maximum 206. One complete cycle of activity occurs over two time periods and repeats continuously every two time periods.

Figure 3:
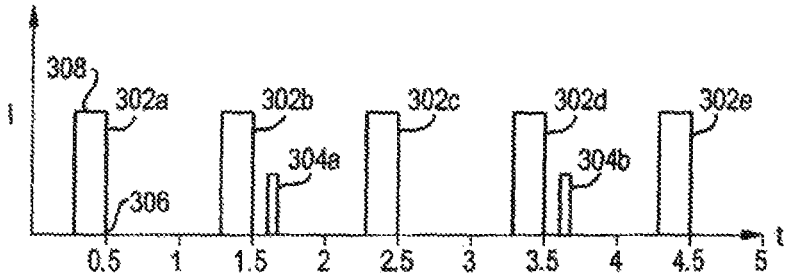
FIG. 3 is another graph of a repetitive motion activity represented by an impulse curve according to one aspect of the present invention.

FIG. 3 is another graph of a repetitive motion activity, this one represented by a impulse curve having individual impulses 302*a*, 302*b*, 302*c*, . . . , 302*n* and impulses 304*a*, 304*b*, . . . 304*n*. The impulses are actually a series of individual points plotted on a time scale, t, having unit time period intervals t1, t2, t3, t4, t5, etc., just like in FIG. 2. Each point can be related to a level of intensity, associated with the repetitive activity. The impulses suggests that the intensity of the activity increases immediately from a minimum point 306 to a maximum point 308, levels off for a period of time, then immediately drops from the maximum point 308 to the minimum point 306. One complete cycle of activity occurs over two time periods and repeats continuously every two time periods.

Figure 4:
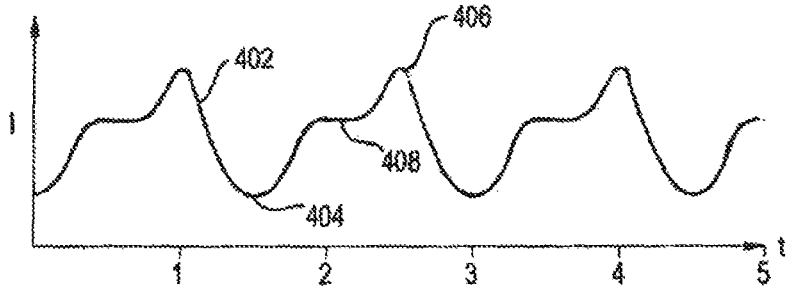
FIG. 4 is another graph of a repetitive motion activity represented by a line curve according to one aspect of the present invention.

FIG. 4 is another graph of a repetitive motion activity, this one represented by a line curve 402. The curve 402 is actually a series of individual points plotted on a time scale, t, as described above. The curve 402 suggests that the intensity of the activity increases over time from a minimum point 404 to a maximum point 406 with an intermediate intensity point 408 that occurs for a portion of the cycle.

Figure 5:
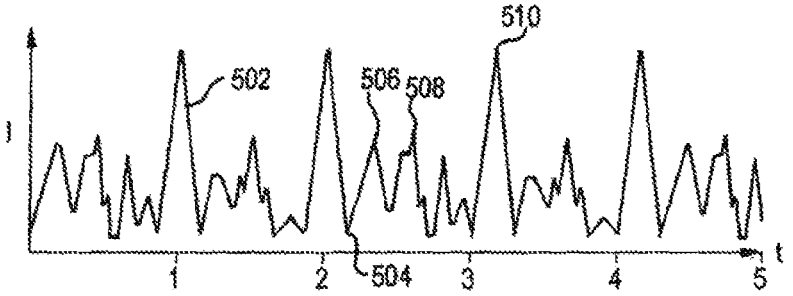
FIG. 5 is another graph of a repetitive motion activity represented by a complex curve according to one aspect of the present invention.

FIG. 5 is still another graph of a repetitive motion activity, this one represented by a complex curve 502 having multiple minimum levels of intensity 504, multiple intermediate peaks of intensity 506, 508, and a maximum level of intensity 510. The periodicity of the curve 502 is the same as the periodicity of the curves shown in FIGS. 2-4. Thus, a user engaged in any one of the repetitive motion activities represented by the curves 202, 302*a*, 402, and 502 could benefit from a motivational musical piece having the same periodicity.

In musical terms, the periodicity is related to the beats per minute (BPM) or tempo of the music. For example, FIG. 6 is a drawing of a portion of a musical piece 602 where the music is represented by individual musical notes 604 grouped by even measures 608 measures of time). The tempo of the musical piece is indicated by the meter signature 606, which in the example in FIG. 6 is 4/4 tempo or four beats per measure. If the measure is two seconds, then there are four beats for every two seconds, or two beats per second (120 beats per minute). Music with a tempo in the range of about 120-130 BPM could be classified as normal, while music with a tempo in the range of about 140-160+ BPM could be classified as fast.

FIG. 7 is a graph of a sound wave represented by the line curve 702. The curve 702 has a periodicity of about two time periods. Each point on the curve 702 represents an amount of pressure, P, at a specific period of time. The upper part of the sound wave (i.e., the crest) at point 704 indicates compression; the lower part (i.e., the trough) at point 706 indicates rarefaction. The frequency of sound is the number of air pressure oscillations occurring at a fixed point in space, and is measured in Hertz (Hz). The human ear senses both the pressure changes, measured in decibels (dB) and frequencies (Hz) related to a sound wave.

The present invention includes a software subsystem 124, as shown in FIG. 1, which relates the pressure signals of sound as depicted in FIG. 7 to the intensity levels of a repetitive motion activity as depicted in FIGS. 2-5. Preferably, the software subsystem 124 is adapted to modify the tempo of music in such a way that the modified music matches as close as possible the desired or optimal periodicity or tempo of the user's repetitive motion activity. Sony's ACM® Pro software is an example of a software product that can be used to modify the tempo of music. Here, the distinction is made between a musical composition, which is a music piece that is generated completely new where there was none before, and a modification, which is an adjustment to specific aspects of an existing piece of music.

It is contemplated that the software subsystem 124, which could also be installed on one of the user's electronic devices 104, 106, and/or 108 in addition to or instead of being part of the server subsystem 114, can also be used to add sounds to existing music. Thus, a music piece that does not have a discernable or obvious beat, such as a classical music piece having portions played pianissimo (very soft) alternating with portions played messa di voce (louder then softer), could be modified to include a metronome impulse sound, a voice prompt, a musical note, or some other audible sound having the same tempo as the music piece, but that is more obvious to the user 102.

FIG. 8 is a diagram of a graph showing, on the same time scale, t, a curve 802 representing the change in intensity of a repetitive motion activity and a curve 804 representing the change in pressure of an audible sound associated with music. The curve 804 is shown having a meter 806 of 4/4 tempo. The peaks of the two curves 802, 804 do not occur at the same point in time. Thus, if the curve 802 represents the optimal activity level of the user, the audible sound curve 804 is not sufficient to provide the pacing the user needs to achieve that optimal level because the tempo of the sound curve 804 is too fast. FIG. 9 is a diagram showing the curve 802 as shown in FIG. 8, with a tempo-modified curve 804'. Now, the curve 804' has the same tempo as the curve 802.

Figure 10:
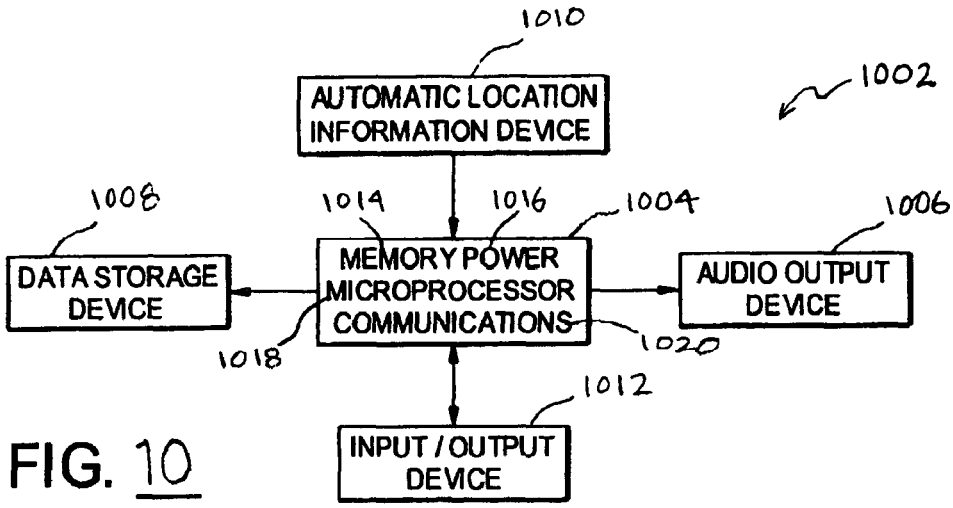
FIG. 10 is a schematic drawing of a data storage and music playback device according to one aspect of the present invention.

In FIG. 10, there is shown a schematic of a data storage and music (or video) playback device 1002 for playing audio (or video) according to one embodiment of the present invention. The device 1002 may a commercially available iPOD®-like player or the like, modified to achieve the objects and advantages of the present invention. The device 1002 may be portable or stationary (or parts of it may be portable and other parts stationary). For example, the device 1002 may need to be embodied in a lightweight, portable housing for a runner. In contrast, the device 1002 could be larger and integrated into the control panel of a treadmill (or removable from the treadmill for use outside by the runner). The device 1002 could be made up of physically separable components such that the audio speakers or video screen could be physically attached to something, like the walls of a pool, while the rest of the components could be transported to a different pool and connected to different speakers/video devices. The device 1002 could be integrated into a whole-house entertainment system. It could also be adapted to be an add-on component to existing storage and playback devices, which may include, but are not limited to, home, gymnasium, or health club, audio-video equipment and portable digital music players. The device 1002 could be part of a file sharing network, an on-demand radio or television service, a cable service, a satellite radio or television service, a mobile phone network or other communications system.

The device 1002 includes a main component 1004 which itself includes circuits and software associated with memory 1014, power 1016, a microprocessor 1018, and communications 1020 subcomponents. It also has an audio output device 1006, a data storage device 1008, optionally an Automatic Location Information (ALI) device 1010, and an input/output device 1012.

The communications subcomponent 1020 of the main component 1004 are intended to provide the device 1002 with the capability of communicating data from the device's permanent or volatile memory subcomponent 1014 to another device via a wireless or wired data communications network. Thus, the communications circuits of the communications subcomponent 1020 may be a modem with an RJ-11 jack for receiving a suitably-sized cable plug for connecting the device 1002 to a traditional public circuit-switched telephone network. The communications subcomponent 1020 may instead be a modem with a transceiver for sending and receiving data packets over a wireless network.

The power subcomponent 1016 of the device 1002 can be provided by conventional power supplies (i.e., 110-volt service). Power may be provided by rechargeable or disposable alkaline or other types of batteries (not shown).

The microprocessor subcomponent 1018 may be any conventional microprocessor, such as a central processing unit of a computer.

Also shown in FIG. 10 is a data storage device 1008, which can be a permanent or removable hard disk drive, memory stick, memory card, or other conventional or miniaturized storage device that is operatively connected to the microprocessor subcomponent 1018 and memory subcomponent 1014 within the main component 1004.

The audio output device 1006 shown in FIG. 10, which is operatively connected (i.e., by wire or wireless devices) to the main component 1004, may include speakers associated with headphones or standup speakers. For example, as suggested above, the speakers may be built into a treadmill, built into the walls underwater in a pool, or mounted on a wall in a gymnasium or home. The device 1002 may have multiple sets of speakers located in different places and each being used to play different types of music. Thus, for example, the device 1002 may be connected to five speakers, four of which play music while the fifth speaker (such as a sub-woofer) plays or emphasizes the tempo of the music.

One of ordinary skill in the art will appreciate and understand that the audio output device 1006 could be a video output device, such as a monitor, light, or other device that produces visible signals that can be sensed by the eyes of the user 102. Thus, light can be used to produce pulses of light energy that the user 102 can detect while he performs a repetitive motion activity.

The ALI device 1010 shown in FIG. 10, which is operatively connected to the main component 1004, will preferably be used on portable devices. ALI devices are known in the art, and include GPS devices. A GPS device uses a receiver to receive telemetry data from a plurality of the constellation of GPS satellites orbiting the Earth. The GPS device will include memory for storing the data, a microprocessor, and software for computing the location of the ALI device from the telemetry data. An accurate clock synchronized to the clock used by the GPS satellites is required to perform accurate location computations. The ALI device can also rely on fixed terrestrial sources, such as mobile phone network transmission/repeater towers and triangulation methods to identify the location of the device 1002.

The input/output device 1012 shown in FIG. 10, which is operatively connected to the main component 1004, could be, for example, a keypad on a mobile phone, a keyboard for a computer, a mouse, a touchscreen, a touchpad, a monitor, or other interface device that allows the user 102 to input commands and allows the device 1002 to present information to the user 102. It is also contemplated that the input/output device could provide an interface for a remote monitoring device (not shown), such as a heartbeat monitor, blood oxygen monitor, pedometer, or some other device for monitoring the current state of the user. That state information can be used to assess whether the device 1002 should manually or automatically adjust the BPM of the music being played on the audio output device 1006. For example, if the device 1002 determines, based on the ALI-type information that the user 102 is slowing down and not maintaining his target pace, the device can warn the user 102 using the audio output device 1006, for example, which would allow the user to user the input/output device 1012 to manually select a different play list of musical pieces that are better matched to the user's 102 current pace.

II. System Operation.

Figure 11:
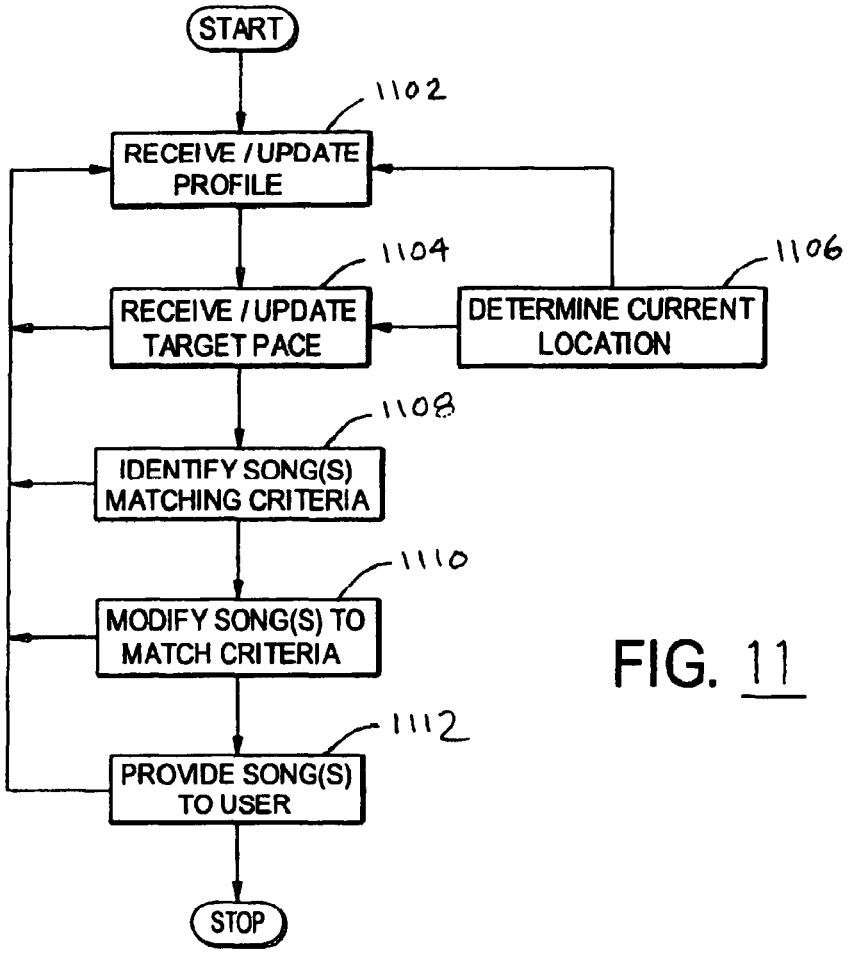
FIG. 11 is a process flow diagram according to a preferred embodiment of the present invention.

FIG. 11 provides a process flow diagram according to a preferred embodiment of the present invention. In process step 1102, a user 102 interfaces with the system 100 by visiting a website through a networked computer 108, wireless or wired phone 104, or by some other means as described above. The system 100 then receives an electronic signal or signals representing user profile information. If the user 102 is a new customer, a new user profile is created. If the user 102 is an existing customer, the user's existing user profile is modified.

The system 100 receives/updates user profiles when or after the user 102 enters personal information using the input/output device 1012, such as a keypad or keyboard. For example, the user 102 may identify the activity they wish to perform and their musical preferences. A web site form can facilitate receiving that information. In addition, the user 102 provides pace information (e.g., BPM) and may select music having a comparable BPM. That information is stored in the user database 116 that may include information provided at later dates by repeat users.

Personal information may also include, but is not limited to, the user's name, gender, height, weight, fitness level, repetitive motion activities, duration of activities, address, email address, stride length, distance to be covered, and desired goal time. Musical preferences may include, but are not limited to, artist, album, song title, and musical genre. That information is stored in the user's profile as described above.

The system 100 receives the user's 102 comfortable pace, heart rate, calorie consumption rate, and other baseline or target information for their respective activities. In process step 1104, the user 102 can determine this by performing a repetitive motion activity (i.e., walking, running, swimming, cycling, lifting, stepping, etc.) for a given time period, such as one minute, while counting the number of steps, strokes, pedal rotations, movements, etc., that he performs in that time period. That information can be automatically or manually sent to the system 100, which receives the information and stores it automatically.

The user 102 who visits the web site generated by the server subsystem 114 may not know the pace or BPM he wishes to achieve for a particular repetitive motion activity. Therefore, the system 100 provides the user 102 a simple method of measuring a target pace, and prompts the user 102 to enter that pace into a web form or otherwise provide the information to the system 100.

For example, if the user 102 wishes to use music to pace him to a desired goal time or optimal level of performance over a discrete time period, such as running a mile under five minutes or swimming 50 meters under 30 seconds, certain information is required. First, the user 102 must know the distance covered per each step, stroke, spin of a wheel, etc., which can be conveniently referred to as "stride length." The stride length over time is the stride period. FIGS. 2-5 graphically illustrate various types of stride lengths over a given time period (the peak intensity represents a complete stride period).

Figure 12:
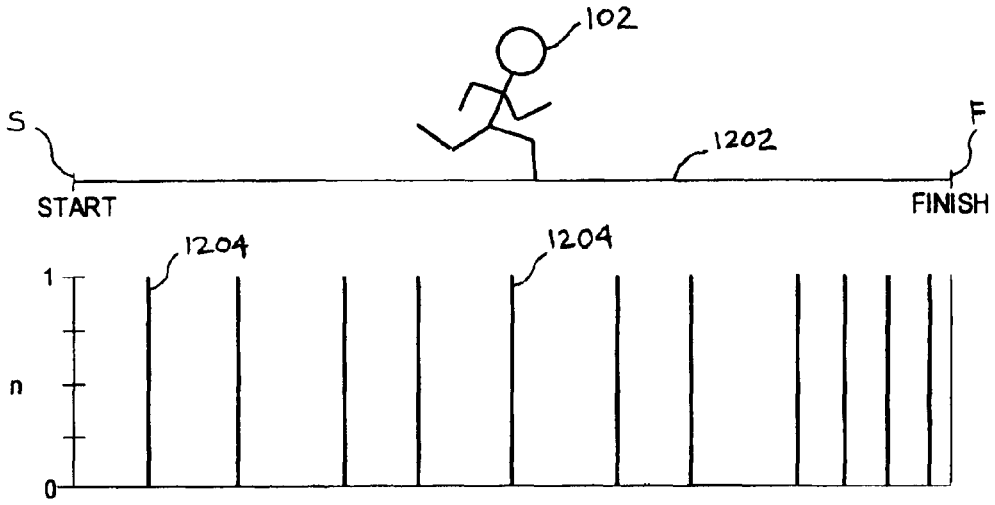
FIG. 12 is a diagram of a user traversing a straight course having a pre-determined geographical start and finish location.

The present invention includes a simple method for the user 102 to determine his stride length. Stride length can be determined by many different methods including, but not limited to, the following:

Mathematical Determination. A user 102 mathematically determines his stride length on a course of specific length such as 100 meters, a mile, etc. This is illustrated in FIG. 12, which shows a user 102 running on a straight course 1202 having a pre-determined geographical start S and finish F location. Mathematically determining stride length is possible if the user provides the number of steps/repeated motions in a given time period, such as one minute, as well as the time to complete a course of specific length such as 100 meters, a mile, a kilometer, etc. As shown in FIG. 12, the distance between the user's steps, which are represented by the impulse lines 1204, is not consistent, so the steps per unit distance should be an average.

Body Measurement. A user 102 estimates his stride length by taking body measurements such as the length from his hip to his ankle, or from fingertip to shoulder.

Average Stride Length. A user 102 refers to a provided table to estimate his stride length, based upon data elements such as height, weight, gender, fitness level, etc. These tables may be provided on the web site generated by the server subsystem 114.

Figure 13:
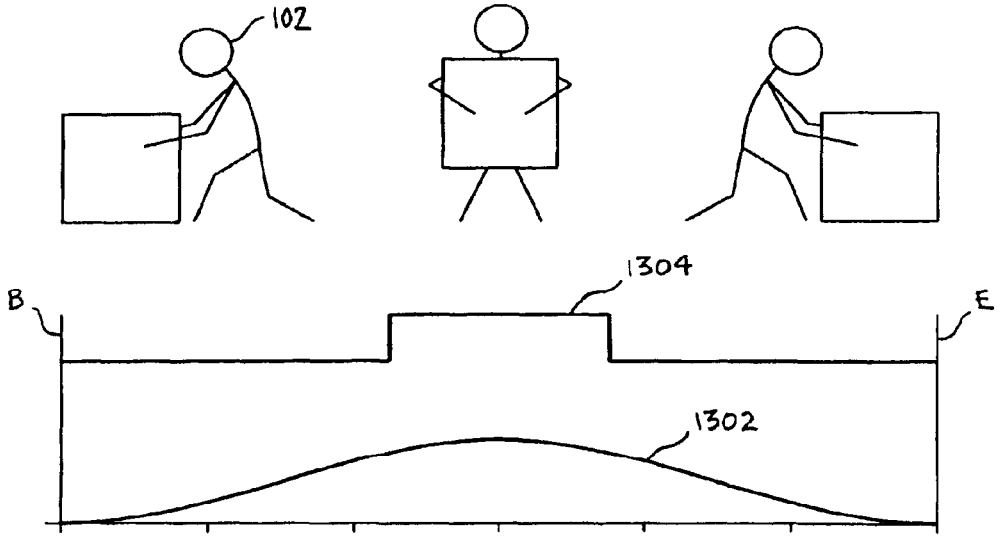
FIG. 13 is a diagram of a user completing a repetitive task having a beginning and ending point.

Geometric Measurements. A user 102 measures the distance or other physical parameter associated with a repetitive motion, such as lifting and moving a box as illustrated, in FIG. 13. The user 102 measures the distance to complete the task between the start of the task at point B and, the end of the task at point E. The time to complete a single repetitive task can be measured as a continuum over the distance B-E, as illustrated by the curve 1302, or as a fraction of the continuum, as illustrated by the curve 1304. Measuring the time to complete a single task as in curve 1304, where only a fraction of total time requires estimating extra time to account for errors and imprecision in the system, distractions, and windup and let down time before and after each task, which may be important in industrial settings.

Referring to FIG. 11 again, in process step 1106, the user's location is determined in real-time or near real-time using any means for obtaining AU-type data. A combination GPS telemetry receiver and software for computing location is one such means for obtaining ALI data. Many mobile phones and computing devices have integrated GPS technology. The present invention contemplates the use of a portable music storage and playback device 1002 having an integrated UPS receiver or is otherwise adapted to operatively connect to or interface with a separate UPS receiver. A touchpad at the ends of a pool lane could be used to estimate location information of a swimmer. Other electrical-optical-mechanical sensing devices, including biometric sensing devices, could also be employed, for example in a work environment, to identify the location of the user 102.

The ALI data can be converted into a suitable signal and automatically sent to the system 100 over the first or second data communications networks 110, 112 (FIG. 1). The system 100 receives the ALI data and stores it automatically. Ideally, time-stamped three-dimensional geographic location information (i.e., latitude, longitude, altitude, and time) are determined on a regular basis and sent by the ALI device 1010 (FIG. 10) and received by the system 100.

Another exemplary means for obtaining the location information of the user 102 involves a geographical information system whereby the user pre-selects routes of travel (e.g., a trail or road course) and, along with pacing information from the user's user profile, an approximate geographic location of the user 102 can be estimated and received by the system 100. Thus, if the user 102 intends to trove/sex one-mile loop over relatively flat terrain identified on a conventional topographic map at a 20-minute per mile walking pace, the approximate location of the user 102 can be determined over the course of the 20-minute activity period using simple mathematical calculations.

In process step 1108, once the user 102 has determined or estimated his stride length, the system 100 receives that information via the networked electronic devices 104, 106, 108, as described above, using an input/output device 1012 (FIG. 10). The system 100 will use the stride length information to identify which song or combination of songs are best suited to meet the pacing needs or time goals for specific distances such as a mile, a kilometer, etc., and that satisfy other criteria specified in the user profile. The system 100 will make those songs available for download by the user 102, or will automatically distribute the songs to an address designated by the user 102, such as a web site address, an e-mail address, a mobile phone number, or some other pre-selected destination address contained in the user profile database or provided manually by the user 102.

The system 100 maintains a separate song database categorized according to variables including, but not limited, to, title, artist, genre, duration (minutes and seconds), BPM, etc. After obtaining specific data from the user 102, the system 100 cross-references user profile data, pace data, activity goals, and musical preferences with the song database to identify songs that match the needs of the user 102. For pacing purposes, a desired pace in steps, pedal strokes, arm strokes, and the like per minute and a song's BPM must be substantially or at least approximately equal. Songs in the database that match the desired paces and musical preferences of the user 102 are presented, to the user 102 in a menu of choices. The user 102 chooses the songs they wish to download and use for pacing purposes.

In some cases, the user 102 may wish to download a song for pacing purposes that does not have a BPM that matches his pacing needs. If the song falls within an acceptable range above or below the target BPM, it is possible to modify the tempo of the song to the desired pace as described above. Using readily available software, like Sony's ACID® Pro, a song's BPM can be altered easily without changing the pitch of the music or negatively impacting the audio quality if the song is in an appropriate digital format.

In process step 1110, if the user 102 requires that a song be modified to match a desired BPM, the following steps are performed. First, after the system 100 receives and creates a user profile containing personal information, desired activity, musical preferences, and desired pace and/or goal time, among other things, the system 100 cross references the pace information and other preferences with a song database. Songs that are a direct match to the BPM preferences and other criteria (e.g., genre) selected by the user 102 are placed on a menu of choices. Songs that fall within an acceptable range above or below the target pace, and which match at least some of the user's criteria, are also placed on the menu of choices. The user 102 then selects the songs that he wishes to download and the system makes those songs available or delivers the songs as described above. Songs that already match the desired BPM can be automatically downloaded to the address provided by the user 102 in his user profile (i.e., the address can include, but is not limited to, a phone number, an Internet Protocol address, or any other addressable location). Songs that require tempo modification are processed through several additional steps either by the system 100 or by the user 102 before they are used.

Songs requiring tempo modification are transferred to a tempo modification program that automatically reads the BPM for that song either from the ID3 tags associated with the song, from the song database, from a vendor that provided the song, or from some other location in the system 100 . . . . " The user 102 may download songs requiring tempo modification, import them into a tempo modification software program, modify them, and then add the songs to their play list or portable audio player. The desired goal or target BPM for the song is obtained from the user's data stored in the user profile database or is provided separately by the user 102. After a song is loaded into the tempo modification program, and the program understands the original BPM and target BPM, the program modifies the song's tempo to the desired BPM as illustrated in FIGS. 8 and 9. Additional information can be electronically added to the song data, such as, for example, a repeating metronome beat, a highlight beat, or a word t'e.g., "step" or "go"). The pitch of the song is held constant during this process, and the song is modified without negatively impacting audio quality. The new, modified song file is saved and the data file is made available for download or is automatically delivered to the address specified by the user in an appropriate digital format.

The invention can be used by musicians to provide their original music to the system 100, which any user 102 can then select for his pacing needs.

In process step 1112, the system 100 provides the songs (either original or modified) to the user 102. This can be a free- or fee-based transaction based on a subscription or pay-as-you-go model. The user 102 downloads his customized music to his electronic device 104, 106, and/or 108 (FIG. 1), automatically to his portable storage and playback device 1002 (FIG. 10), a web site server, or to some other device for transfer onto a portable music player. The user 102 then listens to the songs to pace himself to achieve potentially to a desired completion time for a repetitive motion activity.

Figure 14:
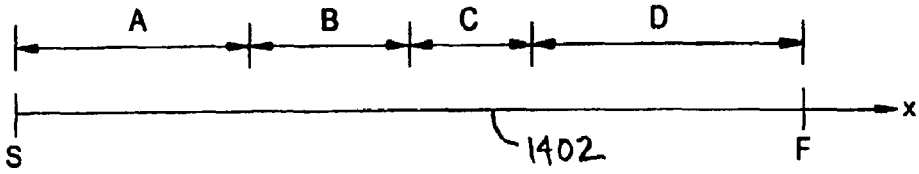
FIG. 14 is a diagram of a path in relation to a coordinate system x.
Figure 15:
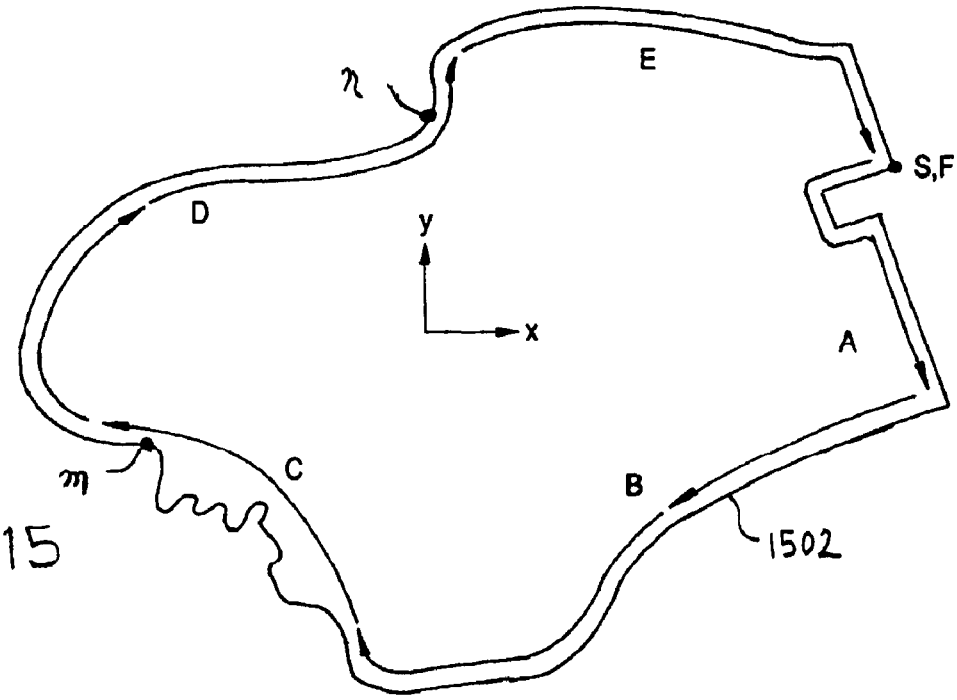
FIG. 15 is a diagram of a path in relation to a coordinate system x, y.
Figure 16:
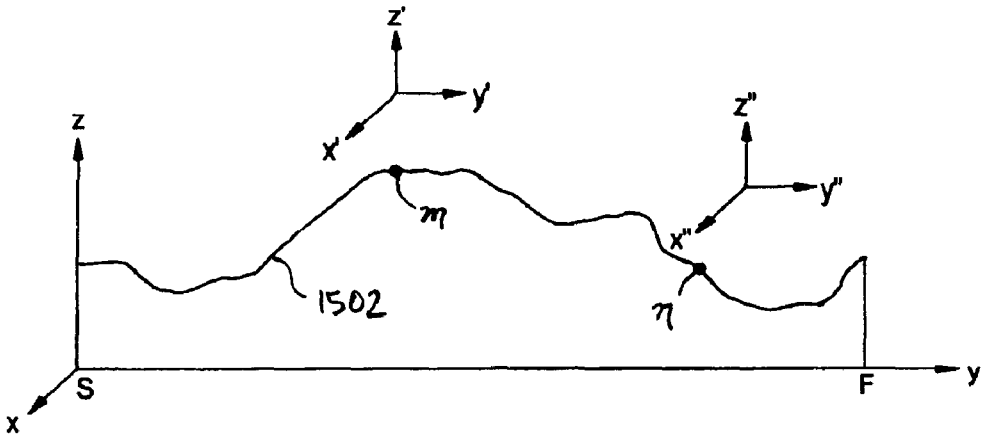
FIG. 16 is a diagram of the path shown in FIG. 15 in relation to a coordinate system x, y, z.

FIGS. 14-16 illustrate various uses of a portable data storage and music playback device 1002 according to one aspect of the invention. In FIG. 14, shown therein is a path 1402 in relation to a coordinate system x (representing a linear dimension). The path 1402 can be defined by a linear distance between spaced-apart points S and F. The path 1402 can be further defined by a finite number of linear path segments A, B, C and D, which, in the case of FIG. 14, do not overlap with each other. For description purposes, assume path 1402 between points S and F is 50-meters long (i.e., the length of a lap pool), and path segments A, B, C, and D are 10-meters, 8-meters, 7-meters, and 15-meters, respectively (thus, they add up to 50-meters or the total length of the path 1402). The user 102 swims 50-meter laps and listens to music (or observes light pulses) having a constant BPM tempo that has been adjusted specifically to the user's swim stroke so that he can maintain as constant a stroke as possible toward the goal of completing 50 meters within a set time period.

The device 1002 can also be programmed so that the BPM of the music automatically changes slightly with each 50 meters completed, so that as the swimmer tires, he will still be able to achieve the time goal.

The device 1002 can also be programmed so that the BPM of the music automatically changes in each path segment, so that the BPM of segment A is faster than the BPM in segment B, C, and D, for example. Thus, the device could be used by competitive swimmers, runners, and walkers during fartlek training, which is an athletic training technique in which periods of intense effort alternate with periods of less strenuous effort in a continuous workout. Thus, the BPM of the music assigned to segments A and C could be twice the BPM of the music assigned to segments B and D.

FIG. 15 illustrates another path 1502 in relation to a coordinate system x, y. The path 1502 can be defined by a start position S and a finish position F, which are the same geographical point in space. The path 1502 can be further defined by a finite number of path segments A, B, C, D, and E which, in the case of FIG. 15, do not overlap with each other. For description purposes, assume path 1502 is a 10-mile road and trail route that the user 102, training for a marathon, regularly traverses as part of his training regime. FIG. 16 illustrates the same route in the vertical z dimension and shows the altitude changes that the user experiences over the course of the route. Segment C is a hilly portion of the course and involve a slower switch-back portion up a long hillside through the woods. The geographical coordinates at discrete points in, i.e., x', y', z'), and n, i.e., (x", y", z"), along the route are stored in the memory subcomponent 1014 of the device 1002.

Thus, the user 102 carries his portable data storage and music playback device 1002 during the 10-mile run, and, because the device 1002 is equipped with an ALI device 1010, the system 100 automatically determines the user's real-time or near real-time geographic location along the route 1502 and compares the location to the discrete locations stored in memory. When the user 102 sets out running in segment A, which is a flat road segment of the 10-mile route, the device 1002 plays a specific song having BPM tempo that is consistent with the pace the user wishes to maintain. However, when the user 102 reaches the off-road segment B, the uneven footing requires a slower pace, so the device, knowing when the users enters segment B by comparing the ALI data to the stored location information, changes the BPM of the song or plays a different song having a slower BPM. When the user reaches the twisty segment C, which is the slowest segment of the 10-mile route, the device 1002 begins playing a song having a slower BPM to match the user's short stride length as he traverses the hilly segment C.

The system 100 also has an adaptive capability that supports a user 102 who, for example, is running and having trouble keeping pace with his music. The user 102 may wish to reduce the pace by changing the music he is listening to. The user 102 might have included a rule in his user profile that governs the songs being played by the portable data storage and music playback device 1002. The aforementioned GPS feature in the portable data storage and music playback device 1002 will recognize that the user's 102 pace is dropping off, causing the device 1002 to switch to a slower play list based upon the rules entered by the user 102. The portable data storage and music playback device 1002 itself may provide the user 102 with a manual switch that causes the BPM of songs to become smaller or to play the song slower.

Another example of the adaptive capabilities of the system 100 is as follows. Consider a user 102 who uses a mix of music to complete a route. The user 102 might wish to improve his time the next time he traverses the route by 5%. The system 200 allows the user 102 to submit this request to the device 1002, spurring the system 100 to tempo modify the user's 102 existing mix to be 5% faster than before or automatically provide a new selection of songs that is 5% faster then the previous song mix.

Figure 17:
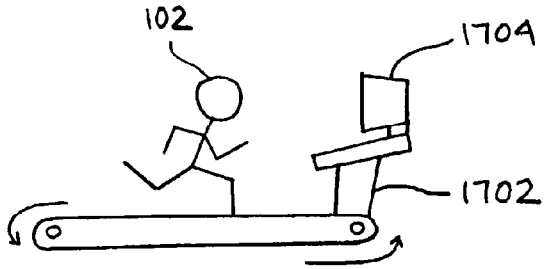
FIG. 17 is a diagram of a repetitive motion activity device being used by a person engaged in a repetitive motion activity.

Another example of the method of using the system 100 is as follows. FIG. 17 is a diagram of a repetitive motion activity device 1702 being used by a user 102 engaged in a repetitive motion activity. The system 100 may be an integral part of, or interconnected to, the separate repetitive motion activity device 1702, which in FIG. 17 is a treadmill, but any device, such as a stair master, elliptical machine and the like, can be used. The device 1702 can determine a speed or rate of rotation of the separate device based on the tempo of the music or video being played on the portable data storage and music playback device 1002. In other words, as a song plays, the device's 1702 computer recognizes the BPM of the musical piece or video being played and automatically adjusts the speed or rate of rotation of the device 1702 to accommodate the song's pace. The user 102 could fine-tune the speed or rate of rotation as well to allow for any variations in his stride length that the separate device cannot automatically sense.

Another example of the method of using the system 100 is as follows. As noted above, the system 100 may be a integral part of, or interconnected to, a separate repetitive motion activity device 1702, such as a treadmill. The system 100 will provide a video feature whereby video images of locations where a user 102 runs, walks, cycles, climb stairs, etc., are displayed on a video screen 1704 in front of the treadmill or other repetitive motion activity device 1702. The frame rate of the video is be automatically calibrated to match the speed of the user's 102 pace, speeding up when the user 102 increases his pace, and slowing down when the user 102 slows his pace. Or, the video files may contain information that produces images representing a route the user 102 might run, walk, cycle, etc., such as, for example, the route as shown in FIG. 15. The video files would be linked the database of information stored for path 1502 such that the tempo of the repetitive motion activity device 1702 and the video being displayed change to reflect the path segments A, B, C, D, and E in order to simulate what the user 102 would have experienced if he had actually traversed the actual path 1502.

The ALI device 1010 can also provide information about the user 102, such as total distance traversed over time, average pace, locations, calories burned, etc., which information can be uploaded to the system 100 and stored in the database 116 as part of the user's user profile.

The ALI information can also be employed in industrial settings where, by knowing the location of the user 102, the system 100 and device 1002 know what activity the user 102 is engaged in. Thus, when the system 100 recognizes that the user 102 is located at position P1 within a factory, based on ALI information it receives from the ALI device 1010, and position P1 is a conveyor system, the device 1002 plays a pre-determined BPM associated with the tempo of the conveyor system. When the system 100 recognizes that the user 102 is located at a new position P2 within a factory, and position P2 is a truck loading area, the device 1002 plays a different pre-determined BPM associated with the tempo of the loading area.

Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

I claim:

1. A pacing system comprising:

storage means for storing a tempo or a pace value corresponding to at least one pre-selected activity type and for storing at least one data file having information for producing a tempo or a pace signal in a form that is audible or visible;

selection means for selecting the at least one data file based on the tempo or pace value;

output means responsive to the selection means for playing the at least one data file to produce the signal; and connection means for transferring the at least one data file to or from the storage means.

2. The pacing system of claim 1, further comprising means for determining a geographic location.

3. The pacing system of claim 2, wherein the means for determining a geographic location is an ALI device.

4. The pacing system of claim 1, wherein the selection means is an input/output device.

5. The pacing system of claim 1, wherein the audible or visible signal is audible musical.

6. The pacing system of claim 1, further comprising tempo computing means for determining an initial tempo or pace value.

7. The pacing system of claim 1, further comprising a software subsystem for modifying the information in the data file such that the modified information is adapted to producing a tempo or a pace signal in a form that is audible or visible.

8. The pacing system of claim 1, further comprising a software subsystem for automatically selecting the at least one data file based on an updated tempo or pace value or an updated activity type.

9. The pacing system of claim 1, wherein the connection means is a wireless network.

10. The pacing system of claim 1, wherein the storage means for storing the tempo or the pace value and the least one data file comprises a user-profile database.

11. The pacing system of claim 10, wherein the user profile database comprises a plurality of user profiles, each of which is associated with one of a plurality of users.

12. The pacing system of claim 10, wherein the user-profile database includes a target tempo or target pace value corresponding to the at least one pre-selected activity type.

13. The pacing system of claim 1, wherein the at least one data file comprises advertising information.

14. The pacing system of clam 1, wherein the at least one data file is selected based on a geographic location.

15. The pacing system of claim 1, wherein the tempo value is determined by dividing a measured number of repetitions of an activity corresponding to the pre-selected activity type by a measured time period during which the activity is performed.

16. The pacing system of claim 1, further comprising movement detection means for determining a position of at least one of the storage means, output means, connection means, and selection means.

17. A method performed on a hand-held computing device, comprising:

designating one or more target tempo or target pace values corresponding to a pre-selected activity type; and adjusting the tempo of one or more audio tracks being outputted to match at least one of the designated target tempo or target pace values.

18. A computer-readable storage medium comprising computer program codes which when executed by a computer processor trigger the computer processor to perform the following steps:

receiving in a user-profile database at least one pre-selected target tempo or target pace value, activity location, or activity type;

providing access to one or more song files categorized by their respective tempo information, each song file having information for producing a sensible tempo, wherein the one or more song files are identified based on the target tempo or target pace value, the goal information, the activity location, or the activity type; and storing a customized training program having information corresponding to the target tempo or pace value.

19. A method for transferring data between a storage and playback device and a server containing at least one audio file having information for producing a tempo that is sensible to at least one user as the at least one user performs a repetitive motion activity, the storage and playback device being capable of storing and playing the information in the audio file, the method comprising, at the server:

receiving a request to substantially match at least one audio file based on its beats per minute for outputting on the storage and payback device;

identifying a metadata tempo tag for each designated audio file, each tempo tag indicating the tempo of the audio file;

causing to be delivered to, or providing to, the storage and playback device the audio file.

20. The method for transferring data as recited in claim 19 further comprising:

at the storage and playback device, receiving the audio file including the tempo tag from the server; and at the storage and playback device, storing the audio file including the tempo tag for future use.

21. The method for transferring data as recited in claim 19 further comprising:

designating a plurality of audio files for downloading to the storage and payback device, the plurality of audio file containing an original version of the audio file and at least one new version of the file having a different tempo;

at the server, causing to be delivered to, or providing to, the storage and playback device the plurality of audio files including a tempo tag associated with each audio file.

22. A repetitive motion pacing system comprising:

at least one server for receiving a plurality of user-provided parameters and transmitting at least one data file;

a user profile database for storing the plurality of user-provided parameters, wherein at least one of the user-provided parameters is a pre-selected activity type of an activity to be performed by at least one user;

a storage device containing the at least one data file, wherein the data file comprises information for producing a tempo that is sensible to the at least one user; and a communications network for transmitting the at least one data file to the at least one user.

23. The repetitive motion pacing system of claim 22, further comprising a data storage and playback device for receiving the at least one data file, identifying the tempo information, and producing the sensible tempo.

24. The computer-readable storage medium of claim 18, wherein the user-profile database is located on one of a remote server, a wireless phone, an ALI-equipped device, or an MP3 player.

25. A repetitive motion pacing system for pacing a user comprising:

a web site adapted to allowing the user to pre-select from a set of user-selectable activity types an activity they wish to perform and entering one or more target tempo or target pace values corresponding to the activity;

a data storage and playback device; and a communications device adapted to transferring data related to the pre-selected activity or the target tempo or the target pace values between the web site and the data storage and playback device.

26. The repetitive motion pacing system of claim 25, further comprising an output device for outputting at least some of the data such that it is sensible to the user.

27. The repetitive motion pacing system of claim 26, wherein the output device outputs a visible signal, an audible signal, or a combination of a visible and an audible signal, and wherein the signal is related to the pre-selected activity or the target tempo or the target pace values.

28. The repetitive motion pacing system of claim 25, wherein the repetitive motion pacing system can determine a geographic location of the data storage and playback device.

29. The repetitive motion pacing system of claim 25, further comprising a plurality of data files, wherein at least one of the data files is automatically selected based on the target tempo or the target pace values, the pre-selected activity, or a geographic location of the data storage and playback device.

30. The repetitive motion pacing system of claim 29, wherein the plurality of data files comprise music files.

31. The repetitive motion pacing system of claim 29, further comprising a software subsystem for associating a beats per minute value to each of the plurality of data files.

32. The repetitive motion pacing system of claim 25, wherein the web site includes a web form for pre-selecting the activity and the one or more target tempo or target pace values.

33. The repetitive motion pacing system of claim 25, wherein the data storage and playback device is a wireless phone, an ALI-equipped device, or an MP3 player.

34. The repetitive motion pacing system of claim 25, further comprising a subsystem for broadcasting the data over one of a television, satellite, or cable network.

35. A computer-readable storage medium comprising computer program codes which when executed by a computer processor on a data storage and playback device trigger the computer processor to perform the following steps:

Allowing the user to input a user-selected activity type, and to select and change a target tempo value;

automatically scanning the data storage and playback device for existing song files and tempo information associated with the song files;

downloading to the data storage and playback device tempo information associated with the song files if the tempo information associated with the song files is missing;

automatically selecting, based on the target tempo value, one or more of the song files having tempo information that is substantially the same as the target tempo value;

sequentially playing the selected song files by the data storage and playback device; and displaying on the data storage and playback device the target tempo value and the tempo associated with the song file when it is being played.

36. The computer-readable storage medium having computer program codes according to claim 35, further comprising connecting to a vendor using a communications device associated with the data storage and playback device to obtain the tempo information associated with the song files.

37. A repetitive motion pacing system comprising:

a user profile database containing a plurality of user defined parameters, at least one of the user-defined parameters being a target tempo value that is substantially the same as an actual tempo of a repetitive motion activity to be performed by at least one user;

a file sharing database containing at least one data file having information for producing a tempo that is sensible to the at least one user as the at least one user performs the repetitive motion activity;

a data storage and playback device adapted to producing the sensible tempo; and a communications network for receiving the at least one data file and distributing the at least one data file to the data storage and playback device, wherein the tempo of music provided to the user is modified to match or substantially match the target tempo or target pace value provided by the user.

* * * * *

UNITED STATES PATENT AND TRADEMARK OFFICE

CERTIFICATE OF CORRECTION

PATENT NO. : 8,101,843 B2
APPLICATION NO. : 12/916869
DATED : January 24, 2012
INVENTOR(S) : William D. Turner It is certified that error appears in the above-identified patent and that said Letters Patent is hereby corrected as shown below:

Column 13, line number 15, replace “AU-type” with -- ALI-type --.

Column 13, line number 20, replace “UPS” with -- GPS --.

Column 13, line number 42, replace “trove/sex” with -- traverse a --.

Signed and Sealed this
Third Day of April, 2012

David J. Kappos

David J. Kappos
*Director of the United States Patent and Trademark Office*